United States Patent [19]

Willits et al.

[11] Patent Number: 4,804,325

[45] Date of Patent: Feb. 14, 1989

[54] WEAPON TRAINING SIMULATOR SYSTEM

[75] Inventors: Samuel P. Willits, Barrington; Thomas E. Kleeman, W. Dundee; Steven F. Willits, Barrington, all of Ill.

[73] Assignee: Spartanics, Ltd., Rolling Meadows, Ill.

[21] Appl. No.: 863,465

[22] Filed: May 15, 1986

[51] Int. Cl.[4] ..... G09B 9/00

[52] U.S. Cl. ..... 434/22; 434/19

[58] Field of Search ..... 434/16–22

[56] References Cited

U.S. PATENT DOCUMENTS

| | | | |
|---|---|---|---|
| 2,023,497 | 12/1935 | Trammel | 42/1 |
| 2,398,813 | 4/1946 | Swisher | 35/25 |
| 3,704,530 | 12/1972 | Arensen | 35/25 |
| 3,781,547 | 12/1973 | Thomas | 230/203 R |
| 3,954,340 | 5/1976 | Blomqyist | 356/152 |
| 3,977,628 | 8/1976 | Barron | 244/3.16 |
| 3,992,099 | 11/1976 | Laughlin | 356/73 |
| 4,021,007 | 5/1977 | Coxe | 244/3.13 |
| 4,050,166 | 9/1977 | Swiatosz et al. | 434/18 |
| 4,065,860 | 1/1978 | Linton | 35/25 |
| 4,079,525 | 3/1978 | Linton | 35/25 |
| 4,137,651 | 2/1979 | Pardes | 35/25 |
| 4,504,232 | 3/1985 | Bond et al. | 434/21 |

*Primary Examiner*—Leo P. Picard

*Attorney, Agent, or Firm*—Jacque L. Meister

[57] ABSTRACT

A weapon training simulator employing a computer with associated memory and software. A simulated weapon with simulated recoil provides hammer fall signals to initiate computation. A quadrature sensor mounted on the weapon generates target position signal based on point sources located on simulated targets. The computer generates real time, video displays and replays and prints out displays of target aim, hit and other information while controlling recoil simulation, providing shot sound and generating speech directions and commands.

39 Claims, 5 Drawing Sheets

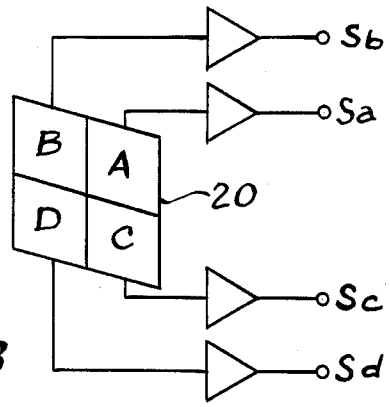
FIG. 3
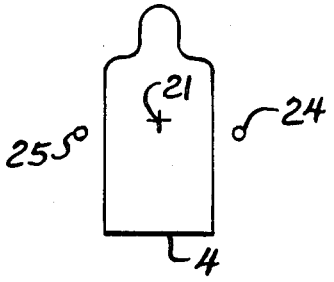
FIG. 6
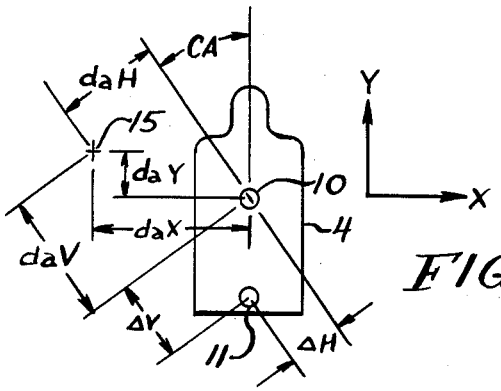
FIG. 7
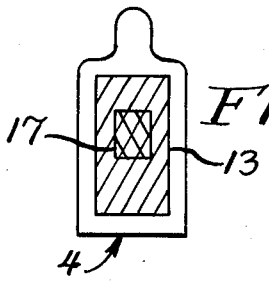
FIG. 12
FIG. 4
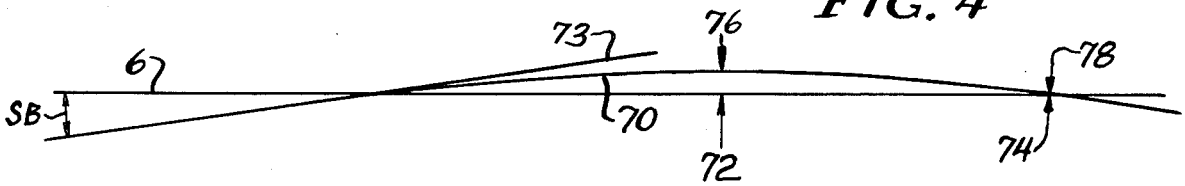
FIG. 5
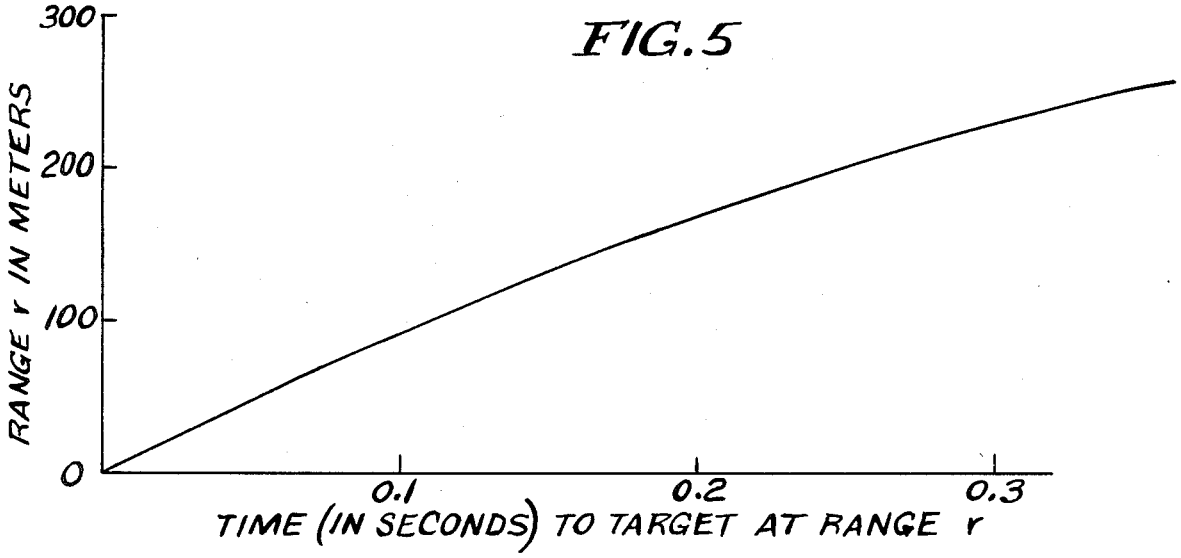

WEAPON TRAINING SIMULATOR SYSTEM

BACKGROUND OF THE INVENTION

This invention relates generally to a Weapons Training Simulator System and more particularly to improvements in the sensing apparatus for such a system integrated with control function apparatus.

In small arms training using either actual rifle firing or simulated firing, the inexperienced shooter must learn to hold, aim, and fire. Each of these tasks presents unique difficulties and various techniques and devices have been developed over the years to help novice shooters acquire the skills needed to accurately and repetitively hit designated targets under differing conditions.

Holding a rifle steady not only is difficult to do but it is even more difficult for an instructor to assess the probable causes of unsteadiness. In training which will utilize actual rifle firing, the trainee reviews both illustrations and demonstrations of correct posture before practicing under the watchful eye of an instructor who by careful observation can detect gross errors. When the trainee has become reasonably proficient in holding, he proceeds to dry-firing practice where the trainee aims an unloaded weapon at a point target while maintaining a coin or flat washer balanced on the rifle barrel. This "Dime/washer" exercise provides performance feedback to both the instructor and trainee. Lastly, the trainee is told to aim the rifle at a target, observe the position of his sights on the target, and try to hold steady.

After becoming familiar with "holding", the trainee is introduced to "aiming" where three methods are commonly used. The first method like in the "holding" training uses illustrations, some static and some where the trainee moves a weapon front sight into position on a target. An actual rifle is not used.

The second "aiming" method is called the "target box" exercise. In this method, the rifle is immobilized in a cradle while the instructor/coach sits on a wooden box several meters in front of the rifle. The coach holds a movable target against the front of the box. In the center of the target is a small pin-hole while behind the target, taped to the box front, is a sheet of blank white paper. The trainee shooter looks through the sights of the immobilized rifle and directs the coach to move the target until the sights are aimed at the target center. The coach then puts a pin-hole in the white paper through the hole in the center of the target. This exercise is repeated several times and then the spread of the pin-holes in the white paper is checked which enables the coach to determine if the trainee can acquire the same aiming point repeatedly. By reversing roles and comparing the position of the pin-holes, the instructor can determine if the trainee is using a correct aiming point.

The third "aiming" training technique uses a so called "Cheater Device" with which the instructor can observe the trainee's sighting as it takes place. A small pane of tinted glass, set in a mounting bracket, is positioned just behind the rear sight at a 45° angle to the line of sight and functions as an image divider. The trainee can hold and aim the rifle normally, his sight being only slightly dimmed by the tinted glass.

While the shooter aims, the instructor, positioned to one side of the rifle, can observe the trainees aiming point reflected off the tinted glass. Poor resolution, small size of the reflected image and the required visual accuity in the instructor, are limitations of this method.

Firing is the third skill to be learned and the one most difficult to acquire. In firing, the trainee must continue holding and aiming while the trigger is pulled causing the hammer to fall and the rifle to fire. Gun shyness causes flinching and bucking as the trainee makes sudden movements in anticipation of the coming recoil and shot noise. Sqeezing the trigger is tricky; movement of any part of the trainee's body other than the tip of the trigger finger will cause the rifle's point of aim to shift. Many missed shots occur because of small shifts in the aiming pooint during the 0.1 second or less interval before firing. Five methods are commonly used to train a novice in firing skills.

The "dime/washer" exercise described above in connection with "holding" is also useful in firing training. In addition to holding the rifle still, the trainee now attempts to pull the trigger without causing the dime or washer to fall off the barrel. As with the holding exercise, no bullets are used in this exercize; the rifle must be cocked and the dime or washer replaced after each trigger operation.

In a second firing exercise, the trainee practices operating the trigger of a cocked unloaded rifle while carefully watching the front sight's position on a target. Both the first and second exercise work on what is called "trigger control" which is defined as what happens to aiming during trigger squeeze and, "follow through" which is defined as what happens immediately after the hammer falls. Properly executed, the front sight will remain motionless during trigger squeeze and after the hammer falls. The first firing exercise provides coarse information to instructor and trainee, the second exercise provides finer information but only to the trainee.

A third firing exercise which tests the trainees "follow-through" is one known as the "ball and dummy" exercise. A magazine is randomly loaded with live (ball) and dummy ammunition. The instructor then watches the trainee fire. If the shooter correctly squeezes and follows through, the rifle will remain still when a dummy round is in the chamber and the trigger pulled. Inadequately trained or practiced shooters will noticeably lower the front end of the rifle in anticipation of a recoil.

A fourth firing exercise termed "shot group analysis" can expose shooters or trainees who only occasionally fail to operate the trigger correctly or follow through properly. A tight group of bullet holes in the target with a few scattered shots indicates the shooter is occasionally moving the rifle before the bullet (round) leaves the barrel. Stray shots low and right are typical of left hand shooters and low and left are typical of right handed shooters.

A final live fire firing exercise has the trainee mark after each shot where he thinks the round hit the target based on his perceived sight picture at the moment of firing. He then receives and marks the actual hit point of the shot and compares it with his perceived point. Comparison of these two points over a series of shots helps the trainee learn and understand the relationship between his rifles sights and the bullets trajectory. This both encourages trainee's to concentrate on the sight picture as they fire and can also provide information for diagnostic analysis of the above described firing faults as well as the "zero" of the weapon. A random discrepancy between each pair of marked shots indicates slight alignment or holding errors, consistent displacement between pairs indicates an unzeroed rifle and, sporadic discrepancy between pairs indicates one or more of flinching, bucking or trigger control faults.

Although millions of shooters have acquired some level of competence by training with these methods, there are obvious shortcomings. Principal among the shortcomings are cost and skilled instructor availability. Both the cost of the rounds of small arms ammunition and of instructor training time to train an expert rifleman is very high. It has been found that expert trainers with unlimited time and ammunition can, using these conventional training methods, produce a quality rifleman but, time, ammunition and expert trainers are in short supply in today's training environment.

Various devices and methods employing these methods to assist in the training process have been suggested and developed. Among those have been devices to simulate shot sound and recoil to impart realism to the training process when not using actual weapon firing. In particular, the U.S. Patent of Linton, et al, U.S. Pat. No. 4,065,860, describes a shot sound synthesizer and U.S. Pat. No. 4,079,525 also of Linton, et al describes a weapon recoil simulator. Recoil simulation to achieve realism has also been described by various others including Arenson in U.S. Pat. No. 3,704,530 who imparts an electrical shock to the trainee and Swisher in U.S. Pat. No. 2,398,813 who uses an electro-magnet powered hammer to move the handgrips of an automatic weapon simulator. Still others have suggested various electro-optical aiming-target designation systems useful in training simulators. Among these are Blomquist, et al, in U.S. Pat. No. 3,954,340 and Coxe in U.S. Pat. No. 4,021,007, both of whom describes quadrant detectors utilizing a blurred image of the target scene on the detector.

While each of the foregoing enumerated devices and others have attacked various parts of the training problem, none have attempted to provide in a single device and system the means for overall training of a novice with only minimum intervention by an instructor.

SUMMARY OF THE INVENTION

It is a principal object of the invention to provide a new and improved device and system for overall weapon training.

Another object of the invention is to provide a new and improved device for effecting weapon training incorporating means for training in holding, aiming and firing.

Still another object of the invention is to provide means for improving linearity in system sighting response.

Yet another object of the invention is to provide novel optical systems for improving sighting system Another object of the invention is to provide new and improved means for introducing weapon system ballistics into a weapon training simulator.

A further object of the system is to provide means for sensing weapon orientation at the time of firing.

A still further object of the invention is to provide the trainee with the feedback normally provided by an instructor and at various skill levels.

The foregoing and other objects of the invention are achieved by the inventive system which provides a simulated weapon subject to recoil and carrying a sighting system aimable at a system target scene and provided with feedback through a system console having system controls for effecting various training exercises. The nature of the invention and several features and objects will more readily be apparent from the following description of certain preferred embodiments thereof taken in conjunction with the accompanying drawings.

DESCRIPTION OF THE DRAWINGS

FIG. 3 is an enlarged schematic view of the detector of FIGS. 1 and 2;

FIG. 4 is a schematic diagram illustrating the ballistics of weapon firing;

FIG. 5 is a graphic representation of the time-of-flight of a projectile for various target ranges;

FIG. 6 is a diagram of a target showing target illumination sources;

FIG. 7 is a diagram of a system target illustrating weapon cant angles;

FIG. 12 is a diagram of a target illustrating critical target areas; and

DESCRIPTION OF THE PREFERRED EMBODIMENTS

Figures 1, 2:
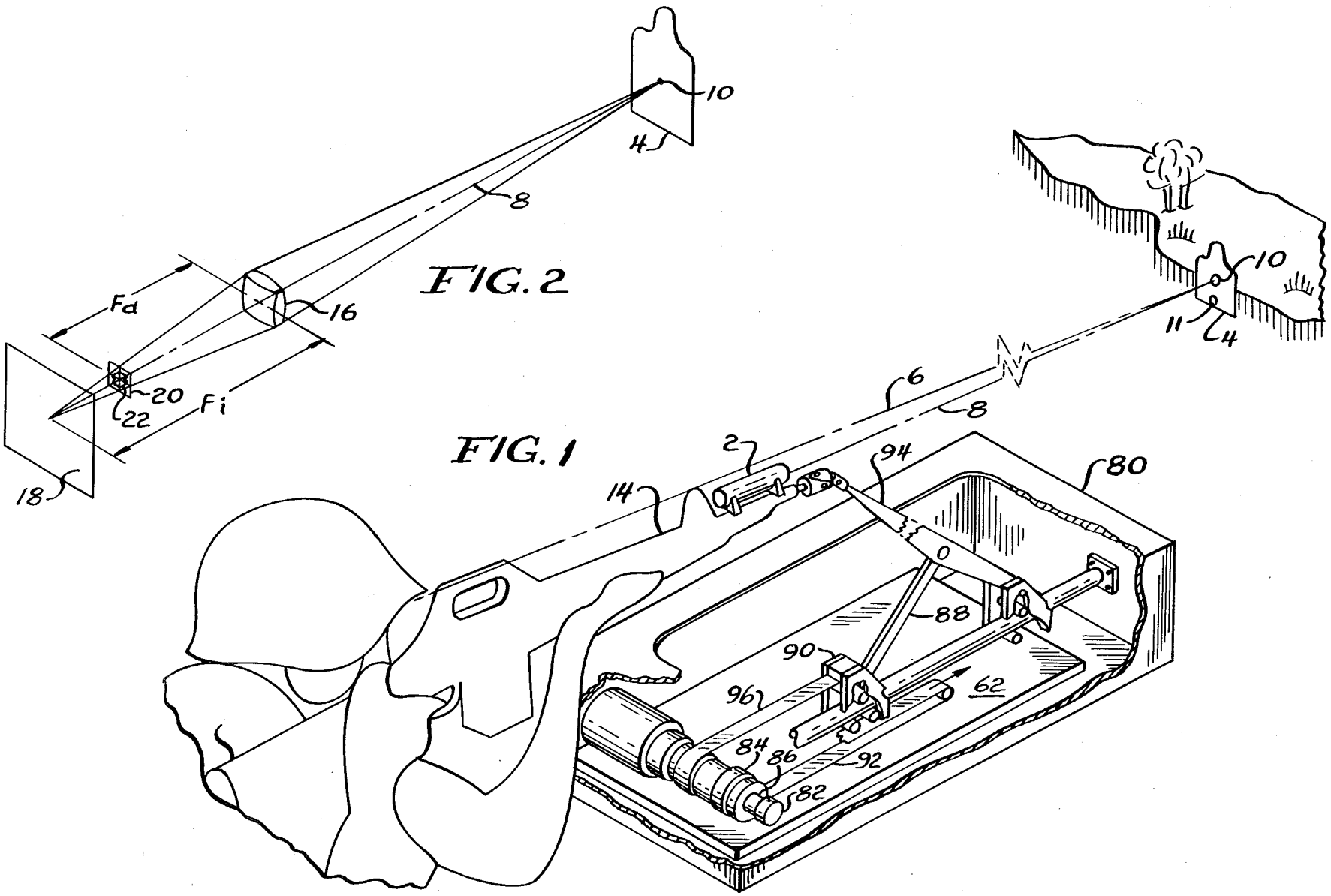
FIG. 1 is a perspective view of the portion of the weapon firing simulator system of the invention exclusive of the system console.
FIG. 2 is an optical schematic showing a preferred embodiment of the weapon sighting system.

FIG. 1 illustrates in perspective form a portion of the inventive weapon training simulator of the invention. As shown, the simulator is principally comprised of a weapon 14 connected to a recoil simulator 62 mounted in housing 80. Advantageously, the recoil simulator is as described in U.S. Pat. No. 4,079,527 of Linton, et al, discussed above. Mounted on the weapon is a sensing system 2 with optical axis 8 aimed at an illumination source 10 on target 4. An additional illumination source 11 is provided for a purpose explained below. The sight line 6 of the trainee holding the weapon intersects optical axis 8 at the target 4.

An optical schematic of a preferred embodiment of the weapon mounted sensing system is shown in FIG. 2 where an objective lens 16 having an optical axis 8 forms an image of the target mounted illumination source 10, near the plane of a quadrature detector array 20. Becauase array 20 is disposed in front of the image plane 18 of lens 16, the image 22 of source 10 is blurred on array 20. Array 20 is shown in enlarged detail in FIG. 3. It is a special feature of the invention that objective lens 16 either be square as shown or have a square aperture. It has been found that the square lens (or aperture) results in a more linear relationship between the signals from array 20 and angular deviation of source 10 from optical axis 8. The blurring of the image caused by sensor location in front of the image plane also contributes to linearity and, it has been found that the location in front of the image plane is superior to one behind it. The exact relationship between the detector signals and the angular deviation are set forth in the following equations:

$Fd$ = distance from lens 16 to detector 20
$Fi$ = distance from lens 16 to image plane 18
$D$ = size of square objective lens 16
$Xv$ = vertical angular deviation
$Xh$ = horizontal angular deviation
$Sh$ = horizontal signal due to angular deviation
$Sv$ = vertical signal due to angular deviation
$SA$ = Output signal from sensor 20$A$
$SB$ = Output signal from sensor 20$B$
$SC$ = Output signal from sensor 20$C$
$SD$ = Output signal from sensor 20$D$ $$Sv = K \times \frac{SA = SB - SC - SD}{SA + SB + SC + SD} + K \times \frac{Xv \times Fd \times (Fi - Fd)}{D \times Fi}$$

$$Sh = K \times \frac{SA + SC - SB - SD}{SA + SB + SC + Sd} = K \times \frac{Xh \times Fd \times (Fi - Fd)}{D \times Fi}$$

The above equations are correct for the square lens 16 as the image 2 of the source 10 moves about on the quadrature detector array 20 until the deviation of optical axis 8 (and sight line 6) from the source 10 becomes large enough to cause image 22 to move off one or more of the 4 quadrants of the detector. At that point the signals from the detector array become non-linear.

If, however, a conventional round objective lens had been used in place of square lens 16, the above equations would only apply in the central area of the intersection of all four sensors of the quadrature array and there would be an increasingly nonlinearity introduced as the round image of the source 10 moves away from the central area.

Figure 9:
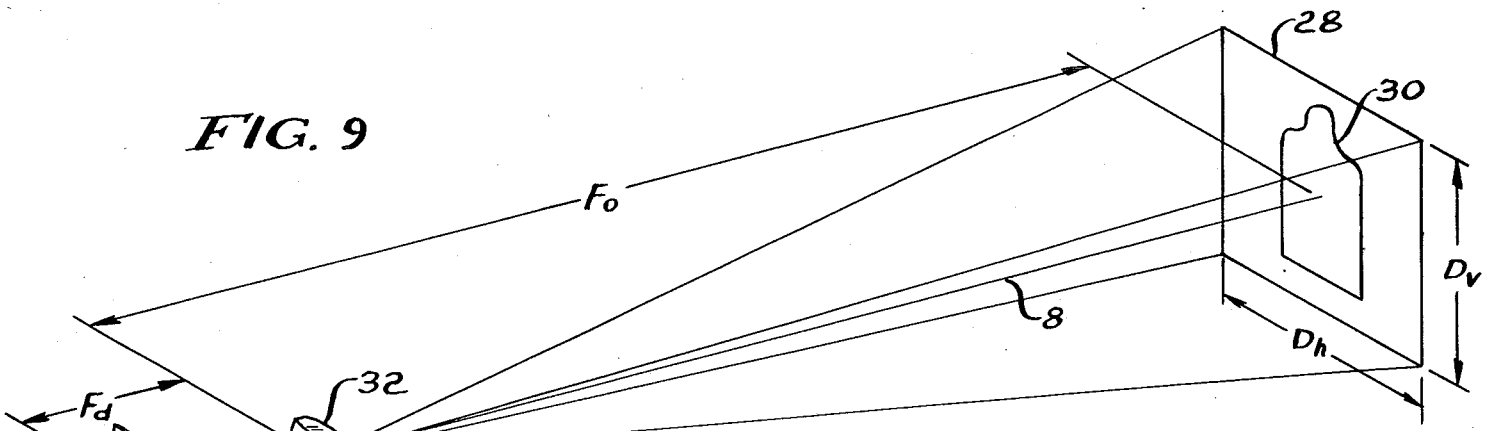
FIG. 9 is an optical schematic diagram illustrating an alternate optical system illumination source.

Another technique for achieving linear outputs from a quadrature detector array 20 is illustrated in the optical schematic diagram of FIG. 9. In the FIG. 9 embodiment, the target illumination source 28 completely defines the angular resolution of the target area on the detector array 20. Target illumination source 28 is shown as square having a vertical dimension of Dv and a horizontal dimension of Dh and is uniformly diffuse. The silhouette target 30 is transparent to the radiation from source 28. As shown in FIG. 9, optical axis 8 of lens 32 is centered on the target 30 and illumination source 28 with the image 29 of source 28 centered on detector array 20. Because the source 28 is controlling the image 29, lens 32 can be either a conventional round objective or a square one as shown and described in connection with FIG. 2 and, the detector array 20 can be located in the image plane 18 simplifying optical alignment procedures.

To achieve best signal linearity with the optical axis 8 aimed anywhere within illumination source 28, the image 29 of the source 28 on detector array 20 must be no more than one-half the size of the detector array. As can be seen from an inspection of FIG. 9, if the image were larger than one-half, displacing the center of the image less than one-quarter of the distance from the center of the array would result in signal fall-off as the source images falls off the edge of the array.

Assuming these image size and alignment criteria are met, a one inch square illumination source would produce full detector output for one-half inch displacement of the optical axis from the center of the target area. A two inch square source would produce full detector output for a one inch displacement.

The relationship between detector signals and angular deviation of the optical axis 8 from the center of the square source 28 can be seen from an examination of FIG. 3 and FIG. 9 and the following:

$Fd$ = distance from lens 32 to detector array 20
$Fo$ = distance from lens 32 to illumination source 28
$Dh$ = horizontal dimension of illumination source 28
$Dv$ = vertical dimension of illumination source 28
$Xv$ = vertical angular deviation of optical axis 8
$Xh$ = horizontal angular deviation of optical axis 8
$Sv$ = vertical signal due to angular deviation
$Sh$ = horizontal signal due to angular deviation $$Sv = K \times \frac{SA + SB - SC - SD}{SA + SB + SC + SD} = K \times \frac{Xv \times Fd}{Dv \times Fo}$$

$$Sh = K \times \frac{SA + SC - SB - SD}{SA + SB + SC + SD} = K \times \frac{Xh \times Fd}{Dh \times Fo}$$

Both of the above equations remain true until some of the image 29 of the source 28 moves off the edge of detector array 20, or there is one section of the quad detector array with no illumination source imaged on it.

The examination of FIGS. 3 and 9 and the foregoing equations reveals that the relative angular sensitivity of the sensor array 20 in the X and Y axis can be changed readily by changing the dimensions Dh and Dv of the illumination source 28. If the size of Dh and Dv is changed from equal relative to each other, the sensitivity is changed. For example, if Dh is twice as long as Dv, it would result in twice the field and ½ the resolution in the horizontal axis.

Because creation of a uniform diffuse source 28 is both costly and difficult to achieve as well as distracting to some trainees, it is desirable that an alternate source be employed. It is a feature of the invention that the functional equivalent of such a source can be achieved by using the defocussed image of one or more point sources at the target to achieve this and other advantageous effects. Such an equivalent system is shown in FIG. 10.

Figure 10:
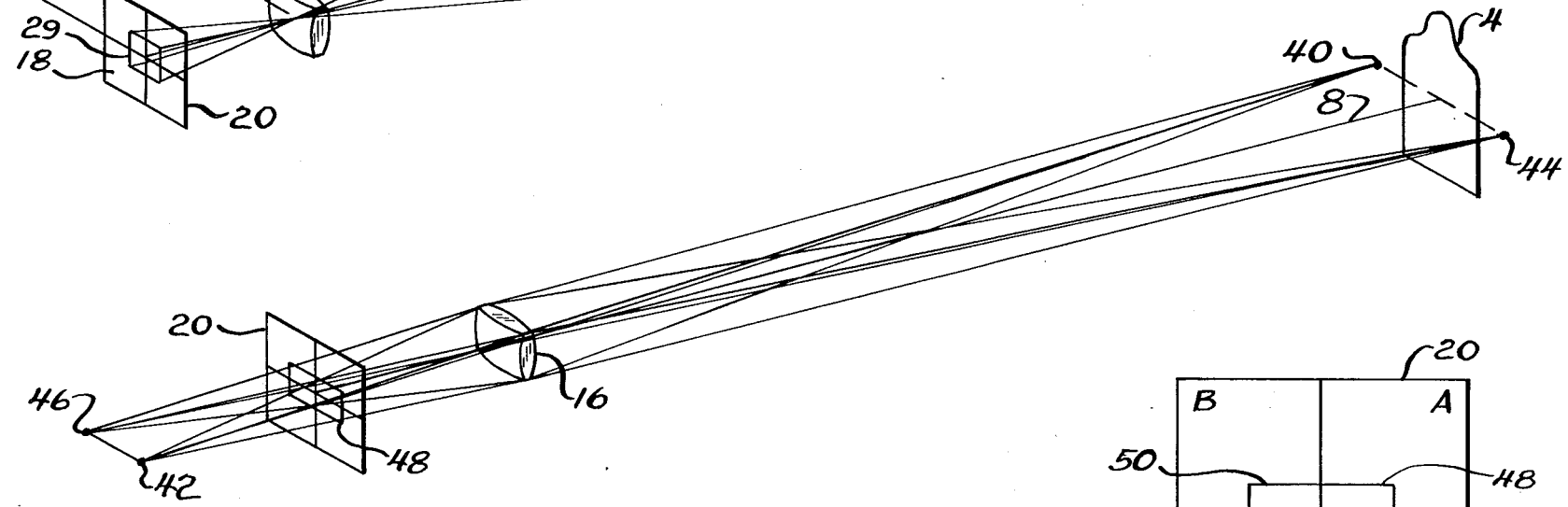
FIG. 10 is an optical schematic diagram illustrating the use of point sources to create diffuse uniform target illumination.
Figure 11:
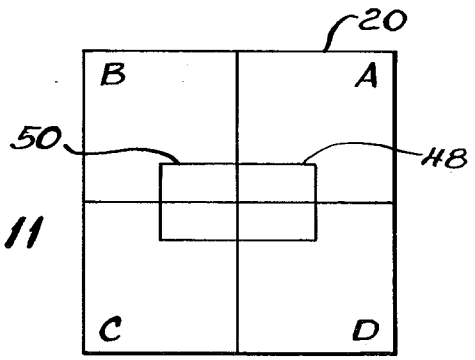
FIG. 11 is an enlarged view of the sensor array of FIG. 10.

In FIG. 10, two point sources, which advantageously may be light emitting diodes, are used in the optical system illustrated to achieve the equivalent of the two uniform diffuse sources. In FIG. 10 with the sensing system optical axis 8 aimed at the silhouette target 4, the objective lens with square aperture 16 focuses the image of point sources 40 and 44 at 42 and 46, respectively, in the image plane. However, quadrature detector array 20 being located in front of the image plane, has imaged on it the squared blurred images of the sources. The location of the detector array in the system is established so that the squared blurred images just touch at the center (on optical axis 8) to form a continuous uniform intensity blurred image with a 2 to 1 width to height ratio. It can be seen that this is the equivalent of a single diffuse source extending across the two sources 40 and 44 and meeting at the intersection of the optical axis 8 on target 4. An enlarged view of the quadrature detector 20 with blurred images 48 and 58 thereon is shown in FIG. 11. Image 48 corresponds to point source 40 and blurred image 50 corresponds to point source 44.

The foregoing described novel technique of using the blurred images of point sources to simulate a uniform diffuse source, can be expanded to use multiple arrangements of such point sources such as 2×2, 2×3, 3×2, 3×3, etc., to expand the field under control of the target. In this manner small targets can use a single point source while large targets might use an arrangement of 4×4 or 16 sources in the target plane to give four times the field and ¼ the resolution.

It is a further feature of the invention that the ballistics of the weapon being simulated can be introduced into the sensor output data by appropriate arrangement of the point sources. As shown in FIG. 4, weapon sight line 6 goes through the center of targets located both at ranges 72 and 74. The trajectory of the projectile is shown at 70 from the muzzle at the left in FIG. 4 to the right toward the target 72 or 74. To compensate for the projectile trajectory if one is aiming at a target at location 72, the target mounted point source is mounted below the nominal center position of the target by the distance between 72 and 76 as measured on the target. Such an offset is shown in FIG. 1 where point source 11 is located below target center 10. This relocation of the point source compensates for projectile trajectory with no change in data processing being required. Similarly for a target positioned at simulated position 74, the target point source is then located at the center position 10 as shown in FIG. 1. In addition to compensating for projectile drop during flight, the inventive system achieves compensation for weapon/projectile ballistics and target horizontal velocity. For a target at range r (meters) moving at velocity v (meters/sec.), the required lead in aim in inches at the target is determined as follows:

| |
|---|
| Tr = time in seconds to target at range r (from FIG. 5) |
| lead = v × Tr × 39.37 |

For a target moving to the right, the point source would be displaced to the right, at the target, the simulated distance given by this formula. This will compensate for the required lead with no change in data processing.

It is a further feature of the invention that the need for moving the target point sources to the right or left on the target as target velocity and/or direction are changed, can be eliminated. As shown in FIG. 6, if point sources 24 and 26 are located to the right and left of target 4's nominal center 21, varying the intensity of each source in proportion to target velocity changes, creates the required apparent source position. The sources 24 and 26 in FIG. 6 are shown displaced somewhat below the target center 21 to compensate for projectile vertical ballistics at the selected target range.

If each point source is displaced the distance required for maximum target velocity v max, the relative amplitude of each source is described as follows where source brightness is equal to B at zero velocity:

$$\text{Amplitude of source in direction of travel} = B \times \frac{(v\ \max + v)}{(v\ \max)}$$

$$\text{Amplitude of source opposite to direction of travel} = B \times \frac{(v\ \max - v)}{(v\ \max)}$$

As pointed out above, it has been found advantageous to employ light emitting diodes (LED's) as the point illumination sources of the invention. As will be appreciated, a visible light on or near the target proves distracting to either a trainee or experienced shooter. LED's are readily available emitting only in the infrared spectrum and hence invisible to the human eye. The LED's are also capable of high speed pulsing at various power levels, features which are also necessary in the preferred practice of the invention.

In all of the above described point illumination source arrangements it has proven advantageous to pulse the LEDs to increase their output signal level. Such pulsing can also be used to provide target identification when more than one target is used and, LED's are especially well adpated to fulfilling these requirements.

Figure 8:
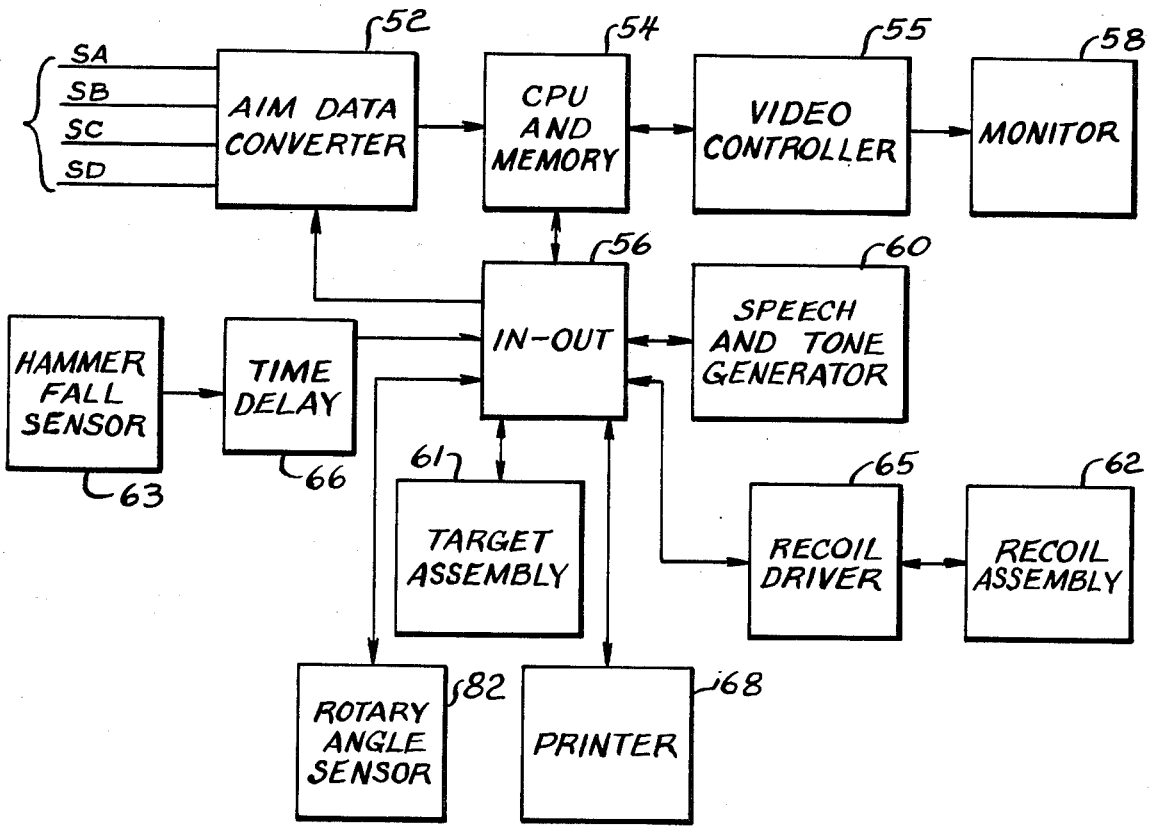
FIG. 8 is a circuit diagram in block diagram form illustrating the preferred circuitry for use with the inventive system.

There are simulation situations where it is desirable to introduce weapon ballistics, target range and velocity plus other corrections or modifications in the electronic data handling instead of at the target as described above. The preferred embodiment of the data processing system shown in FIG. 8 provides this capability. It also provides the ability to identify which target is being sensed when multiple targets are exposed.

The digital aim point data from Aim Data Converter 52 can be modified by CPU and Memory 54 to include corrections for ballistics, target range, target velocity, round dispersion, rifle cant angle, and simulator parallax providing true hit point data.

The first four corrections require only tables of weapon characteristics included in the software plus simulated target range and velocity. Rifle cant angle and simulator parallax corrections require additional sensing and will be described later.

If the simulator has multiple targets the radiation source LED's carried by each target are pulsed in sequence. When multiple targets are exposed simple timing gates in the CPU and Memory 54 identify the target source generating aim point data.

To provide an efficient small arms simulator requires a visual display to give real time feedback of aim and/or hit point. The display elements are represented in FIG. 8 as the Video Controller 55 and Monitor 58. A target assembly which provides simulated targets at various ranges and positions is also required. The target assembly 61 receives its commands and returns target information through the I/O device 56.

Another desirable feature is a speech and tone generator which provides audible instructions, commands and signals to the trainee. Speech and Tone Generator 60 provides this capability.

If the weapon characteristics being simulated include recoil then it is obviously desirable that the simulator provide realistic recoil. The Recoil Assembly as shown in FIG. 1 is controlled by inputs from I/O device 56 and Recoil Driver 65. Amplitude and duration of the recoil impulse are controlled. The impulse is initiated by Hammer Fall Sensor 63 located in the simulated weapon 14. This impulse can start when the hammer falls or it can be delayed to provide additional training and diagnostic information.

Printer 68 can provide a permanent record of anything that appears on video monitor 58. It also provides permanent records of charts showing the overall results of any program. Probably the most important features of the inventive weapon training simulator system are the real time video display of the aim point and/or hit point prior to weapon firing, and replay after weapon firing of the same data, showing several seconds immediately prior to weapon firing. Continuous high accuracy digital X and Y aim point data is supplied to CPU and Memory 54 from Aim Data Converter 52. CPU and Memory 54 continuously converts this aim data to hit point data. Aim and Hit point data are continuously stored in FIFO memories. The size of the memory registers determines the number of seconds prior to weapon firing that can be replayed.

After each shot the FIFO memory data is transferred to the memory location associated with the shot number. In this way when any shot number is called up to the monitor for review, aim point and/or hit point can be replayed. They can be replayed individually or simultaneously.

A significant apparent aiming error occurs if the rifle or other simulated weapon is rotated about its bore axis or "canted." Sensing, measuring and displaying of rifle cant angle is a feature of the inventive system and utilizes two point illumination sources at the target as shown in FIG. 1 to effect cant angle measurement. The primary target illumination source is located at 10 while the second source 11 is located several milliradians away from the primary illumination source and, as shown, the second source is vertically displaced. It could also be horizontally displaced and still function for cant angle measurement. However, for ease of computation, the second radiation source should be located either directly above or below primary source 10 or directly to the right or left. The primary 10 and secondary 11 point sources, are pulsed alternately to enable their identification and enhance signal strength. FIG. 7 illustrates the effect and measurement of cant angle.

The geometric determination of cant angle is based on the formula which follows where:

$CA$ = cant angle
$\Delta H$ = horizontal component of cant angle
$\Delta V$ = vertical component of cant angle $$\tan CA = \frac{\Delta H}{\Delta V}$$

In FIG. 4, the Sight Line-Bore Angle is designated SB and is defined as the angle between the rifle sight line 6 and the bore line 73. It is because this angle exists that errors in the projectile hit point occur when the rifle is canted. The angular hit point errors produced by a cant angle CA are defined by the following equations:

$$\text{Error Angle } X = SB \times \sin CA$$

$$\text{Error Angle } Y = SB \times (\cos CA - 1)$$

For a typical currently used rifle such as the M16A-1, SB is approximately 0.002 radians. For small cant angles CA, on the order of 10° or less, the hit point error is small even at ranges as long as 300 yards. Where, however, cant angle reaches 75° as it frequently can do when the shooter fires while wearing a gas mask, the error becomes significant.

at 10° cant angle and 300 meters range,
error distance $x' = 0.002 \times 300 \times \sin 10° = 0.1$ meter
at 75° cant angle and 150 meters range,
error distance $X' = 0.002 \times 150 \times \sin 75° = 0.29$ meters
error distance $Y' = 0.002 \times 150 \times (\cos 75° - 1) = -0.22$ meters The situation with weapons having a greater sight line-bore angle is much different. Thus, for the weapon known as LAW (light anti-armor weapon), SB is approximately 0.08 radians. Then, for a range of 250 meters and a Cant Angle CA of 10°, the following results:

$$\text{error angle } X = 0.08 \times \sin 10° = 0.14 \text{ radians}$$

$$\text{error distance } X' = 0.14 \times 250 = 3.5 \text{ meters}$$

This is clearly a significant error and shows the need for cant angle sensing and correction and, it is a feature of the invention that the computation and display of Cant Angle is accomplished.

There is still another cant angle error which is generated by the inventive sensing system itself. Referring to both FIG. 1 and FIG. 7, if the rifle sight line 6 and therefore sensor axis 8 are both aimed at point illumination source 10, there is zero aim point displacement and a rifle cant angle introduces only those errors described and defined above and this corresponds exactly to the real life situation on a range. However, as the aim point is moved away from source 10, errors are introduced into the aim point measurement when a cant angle is present because the axes of the sensing system are rotated relative to the axes of the target. The following equations give the true aim point displacement angles:

$$\text{displacement angle } X = daX$$

$$\text{displacement angle } Y = daY$$

$$\text{displacement angle } H = daH$$

$$\text{displacement angle } V = daV$$

$$daX = daH \times \cos CA - daV \times \sin CA$$

$$daY = daV \times \cos CA - daH \times \sin CA$$

Correction of these errors are also accomplished by the inventive system.

Another and significant measurement error occurs in simulator systems which typically have a target located relatively close to the simulator weapon. How the error occurs and why it is necessary to correct for it can be seen by referring to FIG. 1 and the following discussion.

In a typical simulator situation, the distance from sensor 2 to target 4 is 100 inches, obviously much less than the hundreds of meters encountered on the range or in the field. To provide a reasonable freedom of motion for the shooter, the rifle must be free to move toward and away from the target at least 5 inches. A typical distance between the sight line 6 and sensor axis 8 measured at the rifle, is 1 inch and the sight line 6 and sensor axis 8 coincide at the target at the nominal 100 inch actual range (that may be used to simulate a range of hundreds of meters). These dimensions give a parallax angle therebetween of 0.010 radians. At an actual range of 95 inches, the parallax angle is 0.0105 radians and at 105 inches is 0.0095 radians or a difference of 0.001 radians. This 0.001 radian difference when aiming at a simulated 300 meter target causes a difference in measured aim point of $0.001 \times 300 \times 39.37 = 12''$. This system induced error arising out of changing parallax angles has been termed Parallanix° for identification. Obviously a 12 inch aim point error is significant when a shooter is proficient because such a shooter should have a grouping of several shots well within a 12 inch circle at 300 meters.

To determine and compensate for Parallanix°, a rotary angle sensor 82 is coupled to slack band drum 84 through shaft 86. Vertical or horizontal motion of rifle 14 does not cause carriage 90 to move but rifle motion toward or away from the target is transmitted to that carriage through recoil arm 94 and pull rod 88 as explained in the above referenced U.S. Pat. No. 4,079,525 of Linton, et al. Motion of carriage 90 causes slack band drum 84 to rotate through action of recoil band 96 and slack band 92. This results in rotation of shaft 86 and a proportional output from rotary angle sensor 82 which is electrically coupled to the computer of the invention where that output is used in the computation and correction of Parallanix° as described further below.

To effect the electronic processing of the analog signal data at the outputs of the quadrature detector array 20 with the targets of FIGS. 1 and 6 to compute corrected aiming point data and display this data in an environment that can simulate a live range with an instructor but with only minimum instructor intervention, the training system of the invention provides a special purpose computer. The circuit diagram of that computer is shown in block diagram form in FIG. 8 with the system console control panel shown at FIG. 13.

As shown in FIG. 8, the amplified analog signals SA, SB, SC and SD at the output of detector array 20 of FIG. 3, are applied to the input of Aim Point Data Converter 52 of the FIG. 8 computer system. The other imputs to the computer are received from hammer fall sensor 63 which is contained in weapon 14 and rotary angle sensor 82 located in the recoil simulator 62. The remaining inputs are commands generated by the control panel of FIG. 13 which is connected (not shown) to I/O (input-output) device 56. These commands instruct the CPU (central processing unit) and Memory which of several internally stored software programs is to be used in execution of a required algorithm.

In all events, the four output signals of the detector array 20 are combined by converter 52 to generate the analog vertical and horizontal aim point deviation signals Sv and Sh, respectively. These analog aim point deviation signals are further converted to the digital form used in further signal processing. The computations are controlled by CPU and Memory 54 acting through and under the control of I/O device 56.

As discussed above in the description of the effect of Cant Angle, two point illumination sources are employed in determination of Cant Angle and these sources are pulsed alternately to enable their identification. The alternate pulsing is under the direction and control of CPU and Memory 54. After the computation of aim point data from the first sensor, similar data is determined for the second sensor and then, these data are compared in CPU and Memory 54 to provide $\Delta V$ and $\Delta H$ values which, in turn, are used in computing Cant Angle under the formula described above.

Figure 13:
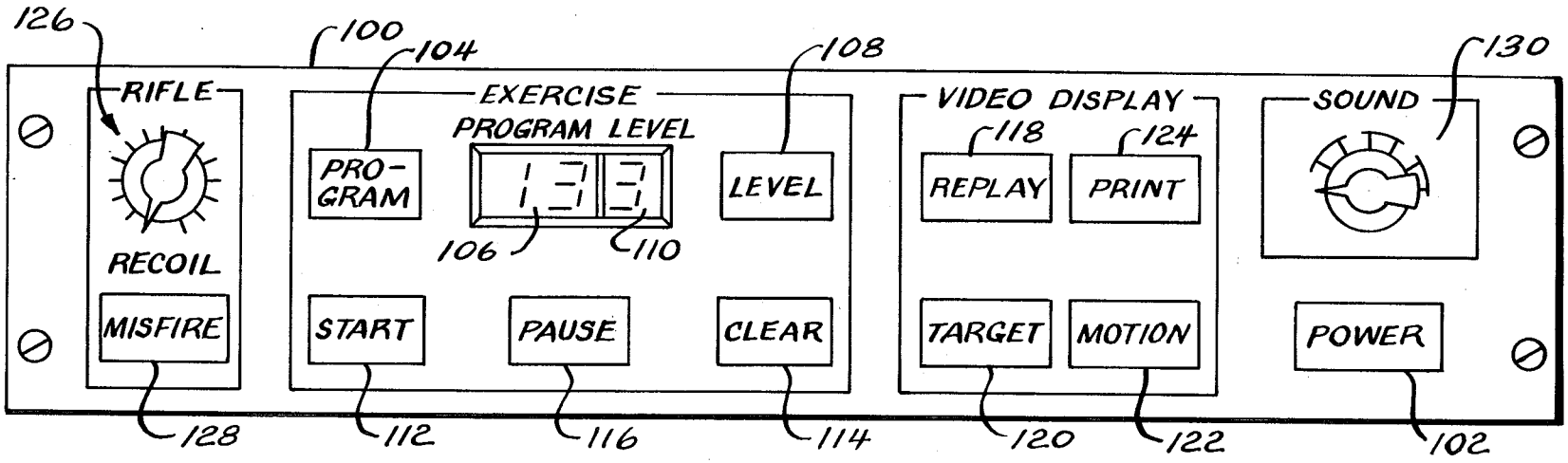
FIG. 13 is an illustration of the system console control panel.

Rotary angle sensor 82 continuously transmits rifle position Parallanix° data to CPU and Memory 54 through I/O device 56. CPU and Memory 54 computes the required X and Y aim point correction and adds it to the aim point data corrected for Cant Angle in CPU and Memory 54. This true aim point data is then continuously stored in an Aim Point FIFO memory. Weapon ballistics, weapon Cant Angle and Target characteristics are then introduced from memory and computed corrections are added to the true Aim Point data in CPU and Memory 54 and this data is continuously stored in the Hit Point FIFO memory. The entire sequence of operations and execution of the various algorithms are controlled by software resident within the CPU and Memory 54 and which is called into action automatically, internally by the CPU and Memory itself, or manually by commands from the I/O device 56 under control of command switch settings entered on the system console control panel 100 of FIG. 13. The control panel 100 of FIG. 13 provides the means for entering command control signals for the weapon training simulator system. The simulator system incorporates software programs at varous skill levels to substitute for instructor provided training or to assist in instructor guided training. For rifle training there are presently 14 different programs each of which may be operated at any one of 3 or 4 training levels of difficulty. The programs have been created to provide instruction in all 3 of the basic skills of holding, aiming and firing with appropriate voice and/or visual feedback to achieve the equivalent of the various training methods used in range training as described above. Thus, there are provided shot noise, instructor commands including real time feedback on trainee performance, video displays and printouts that are the equivalent of the target box and dime/washer exercises as well as many others described below. Each of these programs and levels are produced upon commands entered on control panel 100 as follows.

Power switch 102 energizes the system. Program button switch 104 is used to select a numbered program which is indicated on digital readout 106. Each depression of button 104 advances the program until the end of the sequence of stored programs when it repeats beginning at the lowest numbered program. Each depression of level button switch 108 advances the program level one increment. In general for rifle training the program levels have been established for stationary, walking, jogging and running targets; the selected level being displayed on digital readout 110. Each of the selected programs at each of the selected program levels provides for solution of the basic aiming equations with appropriate corrections for weapon and projectile ballistics at the selected ranges, cant angle, Parallanix°, and lead angle for moving targets along with visual and audio feedbacks as commented on further below. Start button switch 112 starts the selected program and program level from its beginning and clears all scoring and shot data from memory.

Clear button switch is used to clear all scoring and shot data from memory without reinitiating a program start. The pause button switch 116 when pressed once suspends any program exercise in progress while a second depression causes the program to resume.

The system console provides a video monitor 58 and a printer 68 for visual feedback to the trainee and instructor. Tapping the replay button causes the hit location of the last shot to be displayed. Tapping it twice, results in the display of the second to last shot, etc., for up to 64 shots. Holding the replay button down causes a replay of displayed shot to appear, i.e., the movement of the aiming point for the 5 seconds immediately prior to the time of the shot. Target button switch 120 selects one of the targets or a scoring table for display on the video monitor 58.

In many of the systems programs, targets move at more than one speed and in more than one direction. Motion button switch 122 selects each of these target conditions that occurred in the program in sequence, and highlights the hit locations for each of the shots fired in that condition. The print button switch 124 energizes printer 68 which prints and ejects a copy of the score chart or target that is displayed on the video monitor. Rifle recoil selector switch 126 sets the recoil force generated by recoil driver 65 and which is transmitted to the training rifle 14 by recoil assembly 62, anywhere from zero to 140% of that of the M16A1 rifle. Depression of misfire button switch 128 causes the rifle to apparently misfire; i.e., there is no recoil or sound but all other functions such as the video aiming trace and scoring remain normal. The sound selector switch 120 sets the shot sound in headphones worn by the trainee shooter anywhere between zero to 135 db.

As described above, the circuitry of FIG. 8 comprises a Central processor unit and Memory 54 which stores a plurality of software programs in read only memory (ROM) and also provides random access memory (RAM) for storage of hit and intermediate algorithm computation results. While particular currently available microcomputer and memory technologies have been employed in the circuitry of FIG. 8, all or part of these functions may be contained within a single monolithic integrated circuit. It follows that the invention presented herein can take full advantage of present and future microelectronic evolution to perform the functions required of the basic concept.

Many of the implementation details are contained within the software resident in the ROM component of CPU and Memory 54 and modifications to that software or to the form of storage would have to be significant and substantial before departing from the invention described herein.

To implement the training simulation provided by the system of the invention, novel simulation techniques have been developed employing the recoil, sensing and computing systems. Each of these techniques provides means for teaching trainees to hit stationary and moving targets of various sizes and at different ranges. Each of these techniques is embodied in software programs resident in ROM of CPU and Memory 54. Among these training techniques are audible cue techniques that have been designated herein as Aim Tone and Trainer Talk.

The use of Aim Tone can be better envisaged by referring to FIG. 12. For positive feedback to the trainee in teaching a proper sight picture during target acquisition, a tone is generated by tone generator 60 anytime the hit or aim point falls within central hit area 17 of target 4. Also during target acquisition, computer generated speech from generator 60 tells the trainee to move right, left, up or down anytime the hit point is not within area 17. In this manner, the trainee shooter is directed to a proper aim point without instructor intervention. After each shot is fired and after the projectile flight time, a particular tone is generated if the hit point is off the target. At the same time, speech generator 60 tells the trainee the hit point was high, low, left or right. A different tone is generated to indicate the hit point was inside target area 17. The trainee shooter can be required to shoot more accurately by indicating a miss if the hit point is outside of hit area 13.

Trainer talk has many additional functions. It is used to tell the trainee to look at the video monitor 58 when the simulator system determines in accord with predetermined criteria that a shooting error should be displayed. It provides commands similar to range commands when a training program is in progress informing the trainee of target range and/or speed and/or position when this is appropriate. It tells the shooter the score of each shot when he is shooting at a target with scoring rings. When appropriate, it tells the shooter what functions to initiate by control panel entry; whether he must shoot fast, slow, track, trap, point, multiple shot, all based on the particular training program in progress and/or the manner the shooter is performing as measured by the simulator system.

To detect poor follow-through and provide follow-through practice, the system provides "Delayed Recoil." Hammerfall sensor 63 in weapon 14 indicates to the system the instant of trigger pull. If the hammer fall sensor data is delayed by time delay 66, CPU and Memory 54 has no knowledge that delayed recoil is operating.

Another method of providing delayed recoil involves software in CPU and Memory 54 and allows for a special Delayed Recoil Replay. When the undelayed Hammer Fall signal is received at CPU and Memory 54, the aim point data and hit point data are flagged with a hammer fall code before being stored in the Replay FIFO. The hammer fall data is then delayed by the time ordered by the softwear. Aim Point and Hit Point data continue to flow into the Replay FIFO memories during the delay. After the delay, the recoil pulse data is sent to Recoil Driver 65 through I/O device 56. At the same time, the Aim Point data and Hit Point data are flagged with a recoil pulse code and sent to the Replay FIFO memories indicating the end of the Replay for that shot. The Replay FIFO memories are immediately dumped into the Replay memory associated with the shot member and Replay Data storage for the next shot continues in the FIFO memories. During the interval that all of the above data is being stored for replay, it is being displayed on the video monitor so the instructor can observe the trainee shooters aiming and firing techniques directly. The instructor can often critique the trainee shooter without using the Replay function.

When recoil is not delayed, Replay data storage is the same as described above except the recoil data pulse is sent to Recoil Driver 65 from CPU and Memory 54 without delay and the Aim point data and Hit point data are immediately flagged with a recoil pulse and sent to the FIFO memories indicating the end of replay for that shot and the Replay FIFO memories are immediately dumped.

Multiple-Hit Kill is a special Kill mode. When the normal Kill Mode is active in the inventive weapon simulator, the target is dropped from sight after proper delay when a Hit is sensed by CPU and Memory 54. With Multiple-Hit Kill, two or more hits in rapid succession are required before the target drops from sight. This mode is used to teach the shooter how to recover from recoil and reacquire his sight picture to fire more than one accurate shot in rapid sequence at a target that is difficult to hit.

One of the major reasons it is important for the shooter to learn this technique is because of the dispersion of the ammunition. In actual shooting at a long range target, the ballistic characteristics of the ammunition result in hit dispersion which may be almost as large as the target dimension. Thus, in order to have a reasonable probability of hitting the target, more than one round needs to be fired, even when the aim is correct, to increase hit probability. The rounds must be fired fast so a real target does not have time to react to the first round before the second arrives.

Disperz refers to the modification of Hit Point data to include the actual ammunition dispersion data. This data is added statistically to the computed Hit Point in CPU and Memory 54 to provide a realistic simulation of the actual ammunition dispersion in the Final Hit Point. For analysis of each shot, a circle the size of the dispersion, centered on the non-dispersed Hit Point, is displayed on the video monitor for each shot and the randomly selected statistical Hit Point somewhere inside the circle, is displayed as the Hit Point for each shot.

For analysis of overall performance a second form of dispersion capability is programmed into the inventive weapon simulator system. All Hit Points are recorded without dispersion but a Kill probability is computed for each shot based on Hit Point and dispersion. In computing and displaying total results of firing all rounds, the total probabilities are added to get a final performance number. For example, with 10 rounds at 100% probability, 12 rounds at 70% probability, 12 rounds at 30% probability and 10 rounds at 0% probability, the final recorded performance is:

$$\text{Hits} = 10 + 12 \times 0.7 + 12 \times 0.3 + 10 \times 0 = 22$$

Show Cant is the display of weapon Cant Angle on the Video Monitor 58 while the shooter is engaging a target as well as a display during Replay. Say Cant is the audio instructio from Trainer Talk to the trainee shooter telling him that weapon Cant Angle is excessive for the range situation being simulated.

Aim Point Replay utilizes the real time sensing, storage and recall capabilities of the inventive weapon simulator system to display on the Video monitor 58 in real time a replay of the Aim Point of a simulated weapon relative to a target for several seconds prior to firing the weapon. The data initially stored in the Aim Point FIFO memory and then dumped to Replay Memory is the real time data source.

Aim Point Show is the continuous video display of aim point while the trainee shooter is acquiring the target and aiming the weapon in preparation for firing. The display can be either a bright spot or a simulated sight picture. The instructor can use this display directly for correcting shooter problems without using Replay.

Delayed Recoil Replay provides a real time replay of the Hit Point of the simulated weapon 14 when the Delayed Recoil Function is initiated in the inventive weapon simulator. As described previously, both the instant of hammer fall and the instant of recoil are flagged in the Hit Point Replay memory data. As this stored real time data is displayed on the monitor both the Hit Point at hammer fall and at recoil are identified so Hit Point motion and thus weapon motion before and after trigger pull can be observed and analyzed to determine the trigger jerk, recoil anticipation and follow-through of the trainee. Delayed Recoil Replay and Hit Point Replay are always displayed with the target stationary on the Video monitor even for a moving target. This provides a high resolution display for detailed analysis of problems at the time of trigger pull.

Simulreplay is the simultaneous real time display of both the Aim Point Replay memory data and the Hit Point Replay memory data. The Aim Point is displayed small scale to allow for display of the movement of a moving target through terrain across the sector of fire. Hit Point is displayed large scale on a stationary target to allow detailed analysis.

If the "Call It" function is part of the selected training program the trainee shooter is using, the display of Hit Point on the video monitor is delayed after the weapon is fired. The trainee shooter moves a cursor on the blank target display to the position he thinks his shot hit the target. The trainee shooter, or the instructor, then activates the "Call It" shot recording which stores the called shot position. The video monitor then displays the shot and the called shot with the shot identified by shot number in a circle and the called shot identified by shot number in a square. All shots and called shots at the target can be displayed if desired. Also, when the target is printed out for a permanent record the shots and called shots are similarly identified.

When the Autopause function is part of the selected training program, that program is automatically paused and a replay of the last shot or shot grouping is displayed on the video monitor when the trainee shooter is shooting incorrectly. This immediately shows the trainee his error andd forces him to restart the program.

From foregoing description, it can be seen that the invention is well adapted to attain all of the ends and objects set forth together with other advantages which are obvious and inherent to the apparatus and training system. Further, it should be understood that certain features and subcombinations are useful and may be employed without reference to other features and subcombinations are useful and may be employed without reference to other features and subcombinations. In particular, it should be understood that in several of the described embodiments of the invention there has been described a particular computer processing unit with various peripheral memory and inputs/outputs and software programs but that though described in the manner of particular computer elements and programs, other computer elements and programs may be employed to effect a similar result. The detailed description of the invention herein has been with respect to preferred embodiments thereof. However, it will be understood that variations and modifications can be effected within the spirit and scope of the invention as described hereinabove and as defined in the appended claims.

What is claimed is:

1. A weapon training simulator system for hand held weapons comprising means for displaying one or more targets and generating digital output data indicative of target characteristics, a weapon aimable at said displayed targets, said weapon including firing sensor means, a weapon aim sensor system movable with said weapon having output signals indicative of the alignment of said weapon relative to said displayed target, aim data converter means to convert said weapon aim sensor system output signals to digital x-y coordinate data, computer means connected and responsive to the outputs of said firing sensor means and said aim data converter means and said target characteristics output signals to combine and store said outputs as digital data, and display means connected to said computer means for generating a display of said digital information.

2. A weapon training simulator system in accord with claim 1 wherein said firing sensor means comprises hammer fall sensor means.

3. A weapon training simulator system for hand held weapons in accord with claim 1 wherein said generated display is a real time replay of said stored digital information.

4. A weapon training simulator system for hand held weapons in accord with claim 1 wherein said generated display is a real time display of said digital information.

5. In a weapon training simulator system in accord with claim 1, the improvement further comprising
means directing computer output signals indicative of cant angle and allowable cant angle and to initiate display thereof.

6. In a weapon training simulator system in accord with claim 1, the improvement further comprising
said targets each having one or more point radiation sources,
said aim sensor system comprising a quadrature detector array and an objective lens for imaging a defocussed image of one of said point radiation sources on said detector array, and
means for sequentially pulsing each of said point radiation sources to thereby simultaneously identify the aimed at target and provide weapon aiming point data for the target.

7. In a weapon training simulator system in accord with claim 6, the improvement further comprising
a plurality of point illumination sources uniformly disposed about at least one of said targets,
and said objective lens means forming the defocussed image of said plurality of radiation sources associated with one target on said detector array, said defocussed images being substantially contiguous with each other and overlapping the image of said target.

8. A weapon training simulator system in accord with claim 7 wherein said objective lens means has a square aperture.

9. In a weapon training simulator system in accord with claim 1, the improvement further comprising
said targets each having one or more point radiation sources,
said aim sensor system comprising quadrature detector array
means and objective lens means for imaging a defocussed image of one of said point radiation sources on said detector array means to thereby provide aim point position data to said computer means, and
means in said computer means for sequentially pulsing each of said point radiation sources to enable its identification and the identification of said aim point position data.

10. In a weapon training simulator system in accord with claim 9, the improvement further comprising
said objective lens means having a square aperture.

11. In a weapon training simulator system in accord with claim 9, the improvement further comprising
said targets including one or more moving targets, and
location of said target associated point sources on said target offset from the target nominal center position by a distance that is a function of target velocity, target range and weapon ballistics.

12. In a weapon training simulator system in accord with claim 9, the improvement further comprising
two point radiation sources on each of said moving targets, one of which is located to the left of target center and one to the right of target center, and
modulation of the intensity of said target associated point radiation sources to a brightness that is a function of target velocity, target range and weapon ballistics.

13. In a weapon training simulator system in accord with claim 1, the improvement further comprising
means to generate and count computer signals indicative of the number of hits on said target, and
means for indicating a target kill after a predetermined number of hits greater than one.

14. In a weapon training simulator system in accord with claim 1, the improvement further comprising
said target comprising selectable simulated pop-up targets, and
means directing a computer generated target drop signal after a delay equal to projectile flight time after a hit on said target.

15. In a weapon training simulator system in accord with claim 1, the improvement further comprising
means directing computer generation of signals indicative of weapon cant angle and controlling the display of weapon cant angle.

16. In a weapon training simulator system in accord with claim 1, the improvement further comprising
means directing computer computations to add dispersion to hit point calculations, and display of the dispersed shot hit point.

17. In a weapon training simulator system in accord with claim 16, the improvement further comprising
means directing computer computations of a dispersion ring and for additionally displaying said dispersion ring around each undispersed shot hit point.

18. In a weapon training simulator system in accord with claim 1, the improvement comprising
means controlling computer calculations introducing hit probability into the scoring of each shot based on undispersed shot hit point and dispersion data selected under said computer means control.

19. In a weapon training simulator system in accord with claim 1, the improvement further comprising
means directing said computer means to delay display of last shot hit point and to allow positioning on said display means of call shot position and to subsequently initiate simultaneous display and identification of call shot position and last shot hit point.

20. In a weapon training simulator system in accord with claim 1, the improvement further comprising
a rifle parallax position sensor and means to generate computer signals indicative of parallax correction and hit point position with parallax correction.

21. In a weapon training simulator system in accord with claim 1, the improvement further comprising
selectable training program means,
speech generating means, and
said computer means connected to said speech generating means and connected and responsive to said selectable training program means to initiate programmed trainer talk voice commands and instructions.

22. In a weapon training simulator system in accord with claim 1, the improvement further comprising
selectable training program means, and
said program means providing criteria for computer generated incorrect shot signals to suspend execution of the selected training program.

23. In a weapon training simulator system in accord with claim 22, the improvement further comprising
means for automatically displaying a replay of said incorrect shot whenever said program execution is suspended.

24. In a weapon training simulator system in accord with claim 22, the improvement further comprising
means for automatically displaying the shot group including said incorrect shot whenever said program execution is suspended.

25. In a weapon training simulator system in accord with claim 1, the improvement further comprising
means to generate computer signals indicative of a miss if the shot hit point is outside a defined predetermined hit area inside said target.

26. In a weapon training simulator system in accord with claim 1, the improvement further comprising
means controlling computer calculations of weapon cant angle, correction of hit point due to cant angle, and correction of aim point due to cant angle rotation of said weapon mounted aim sensor.

27. A weapon training simulator system comprising
a weapon having firing sensor means,
weapon aim sensor system means,
at least one target,
computer means interconnected with said firing sensor means and said aim sensor means and said target to provide weapon aiming and firing data,
means connected to said computer for displaying weapon sensors and target data,
means for generating speech and aim tone connected to said computer means, and
means directing generation of computer output signals indicative of hit point on said target area during weapon aiming and further directing generation of computer output signals which initiate aim tone when the computer hit point is within the outline of a predetermined hit area inside said target outline, and initiating speech commands directing the shooter to change the position of said weapon aim point when the hit point is outside the outline of said predetermined hit area inside said target.

28. In a weapon training simulator system in accord with claim 27, the improvement further comprising
means directing computer generated signals initiating hit tone generator or miss tone generation after a delay equal to the time of flight of said weapon's projectile.

29. In a weapon training simulator system in accord with claim 27, the improvement further comprising
means directing computer generated signals to initiate voice commands indicating the position of a hit point outside said predetermined hit area.

30. In a weapon training simulator system in accord with claim 27, the improvement further comprising
means directing computer output signals indicative of cant angle and allowable cant angle and to initiate voice commands warning of excessive cant angle when measured cant angle exceeds predetermined allowable cant angle.

31. A weapon training simulator system comprising
a weapon having a weapon firing sensor means,
means for generating simulated recoil of said weapon,
selectable time delay means interposed between said firing sensor measns and said recoil force generating means to delay indication of weapon firing and generation of simulated recoil forces.

32. The method for providing a real time video display in a weapon training simulator system having means for displaying one or more targets, an aimable weapon with hammer fall sensor means, a weapon aiming sensing system movable with said weapon to provide output signals indicative of the alignment of said weapon relative to said displayed targets, computer means connected and responsive to the outputs of said hammer fall sensor means and said weapon aiming sensing system, and video display means, the improvement comprising the steps of
computer processing of said weapon aiming sensor systems output signal data and the output of said hammer fall sensor means to thereby generate aim point data,
computer generation of a delay in the output of said hammer fall sensor means,
utilizing said delayed hammer fall signal to generate a weapon fired signal,
flagging said aim point data at the times of said hammer fall and said weapon fired signal, and
displaying on said video mesans in real time said aim point relative to said displayed targets along with indications of hammer fall and weapon firing.

33. The method for providing a real time video display in a weapon training simulator system having means for displaying one or more targets, an aimable weapon with hammer fall sensor means, a weapon aiming sensing system movable with said weapon to provide output signals indicative of the alignment of said weapon relative to said displayed targets, computer means connected and responsive to the outputs of said hammer fall sensor means and said weapon aiming sensing system, and video display means, the improvement comprising the steps of
computer processing of said weapon aiming sensor systems output signal data and the output of said hammer fall sensor means to thereby generate hit point data,
computer generation of a delay in the output of said hammer fall sensor means,
utilizing said delayed hammer fall signal to generate a weapon fired signal,
flagging said hit point data at the times of said hammer fall and said weapon fired signal, and
displaying on said video means in real time said hit point relative to said displayed targets along with indications of hammer fall and weapon firing.

34. The method for providing a real-time video replay of weapon aim point prior to weapon firing in a weapon training simulator system comprising means for displaying one or more targets, an aimable weapon having a hammer fall sensor means therein, a weapon aiming sensing system movable with said weapon to generate aim point output signal data, computer means connected and responsive to the outputs of said hammer fall sensor means and said aiming sensing system, and video display means, the improvement comprising the steps of
computer processing of the output signal data from said weapon aiming sensing system and said hammer fall sensor to thereby generate aim point data and store same as digital data,
flagging said aim point data at the time of hammer fall,
sequentially storing said aim point and flagged aim point digital data in memory, and
displaying on said video means said sequentially stored aim point and flagged aim point digital data relative to said displayed targets.

35. The method for providing a real-time video replay of weapon hit point prior to weapon firing in a weapon training simulator system comprising means for displaying one or more targets, an aimable weapon having a hammer fall sensor means therein, a weapon aiming sensing system movable with said weapon to generate aim point output signal date, computer means connected and responsive to the outputs of said hammer fall sensor means and said aiming sensing system, and video display means, the improvement comprising the steps of computer processing of the output signal data from said weapon aiming sensing system and said hammer fall sensor to thereby generate hit point data, computer delay of said hammer fall signal to generate a weapon fired signal a predetermined time after said hammer fall signal, flagging said hit point data at the time of hammer fall and said weapon fired signal, sequentially storing said hit point and flagged hit point data in memory and displaying on said video means said sequentially stored hit point and flagged hit point data relative to said displayed targets.

36. The method for providing simultaneous real-time video display of weapon aim and hit point prior to weapon firing in a weapon training simulator system comprising means for displaying one or more targets, an aimable weapon having a hammer fall sensor means therein, a weapon aiming sensing system movable with said weapon to generate aim point output signal data, computer means connected and responsive to the signal outputs of said hammer fall sensor means and said aiming sensing system, and video display means, the improvement comprising the steps of computer processing of the output signal data from said weapon aiming sensing system and said hammer fall sensor to thereby generate aim point and hit point data and store same as digital data, flagging said aim point and hit point data at the time of hammer fall, sequentially storing said aim point and flagged aim point digital data in memory, sequentially storing said hit point and flagged hit point digital data in memory, and simultaneously displaying on said video means said sequentially stored aim point and flagged aim point digital data and said sequentially stored hit point and flagged hit point digital data relative to said displayed targets.

37. The method for providing a real-time video display of weapon aim point relative to one or more targets prior to weapon firing in a weapon training simulator system comprising one or more targets, an aimable weapon having a hammer fall sensor means therein, a weapon aiming sensing system movable with said weapon, computer means connected and responsive to the signal outputs of said hammer fall sensor means and said weapon aiming sensing system, and video display means, the improvement comprising the steps of displaying one or more targets and generating digital output data indicative of target characteristics, generating aim point output signal data from said weapon aiming sensing system as said weapon is aimed, generating a hammer fall output signal from said hammer fall sensor means at the time of weapon firing, computer processing of the output signal data from said weapon aiming sensing system and said hammer fall sensor to thereby generate digital x-y coordinate aim point data, and displaying on said video means said digital aim point data relative to said displayed one or more targets until the time of hammer fall.

38. The method for providing a real-time video display of weapon hit point relative to one or more targets prior to weapon firing in a weapon training simulator system comprising one or more targets, an aimable weapon having a hammer fall sensor means therein, a weapon aiming sensing system movable with said weapon, computer means including memory means connected and responsive to the signal outputs of said hammer fail sensor means and said weapon aiming sensing system, and video display means, the improvement comprising the steps of displaying one or more targets and generating digital output data indicative of target characteristics, generating aim point output signal data from said weapon aiming sensing system as said weapon is aimed, storing weapon characteristics tables in said computer memory means, generating a hammer fall output signal from said hammer fall sensor means at the time of weapon firing, computer processing of the output signal data from said weapon aiming sensing system and said hammer fall sensor means to thereby generate digital x-y coordinate aim point data, computer processing of said aim point data, said target characteristics data and said stored weapon characteristic tables to thereby generate hit point relative to said one or more targets, delaying of said hammer fall signal to generate a weapon fired signal a predetermined time after said hammer fall signal, and displaying on said video means said hit point data relative to said displayed one or more targets until the time of said delayed hammer fall signal.

39. The method for providing cant angle and cant angle corrected aim point and hit point in a weapon training simulator system comprising at least one target with two spaced apart point illumination sources thereon, an aimable simulated weapon including a weapon aiming sensing system thereon to generate output signals as a function of the position of said point sources with respect thereto and a computer, connected to said sensing system for receiving said output signals, the steps of sequentially pulsing each of said point radiation sources to thereby simultaneously identify the aimed at point source and provide aiming point data therefore, computer processing of said aiming point data for each of said sources to determine weapon cant angle and cant angle corrected aim point and hit point.

* * * * *